United States Patent [19]

Gogniat

[11] Patent Number: 4,632,569

[45] Date of Patent: Dec. 30, 1986

[54] TIMEPIECE WITH CALENDAR

[75] Inventor: Paul Gogniat, Bienne, Switzerland

[73] Assignee: Montres Rado S.A., Lengnau, Switzerland

[21] Appl. No.: 808,696

[22] Filed: Dec. 13, 1985

[30] Foreign Application Priority Data

Dec. 14, 1984 [CH] Switzerland ..... 05947/84

[51] Int. Cl.[4] ..... G04B 19/20

[52] U.S. Cl. ..... 368/35

[58] Field of Search ..... 368/35, 37, 28, 223, 368/228, 232

[56] References Cited

U.S. PATENT DOCUMENTS 3,621,648 11/1971 Takagi ..... 368/37

3,901,017 8/1975 Erni et al. ..... 368/37

*Primary Examiner*—Vit W. Miska

*Attorney, Agent, or Firm*—Griffin, Branigan, & Butler

[57] ABSTRACT

The timepiece includes in addition to the hours and minutes hands a calendar mechanism comprising at least one date ring on which is placed an index. The dial includes an annular zone of transparent material through which said ring appears. In a preferred version of the invention the data indications are borne by one of the surfaces of the transparent zone. If the colors of such indications and of the ring are the same and the color of the index different from that of the indications all indications except one will be concealed—that behind which is found the index.

19 Claims, 12 Drawing Figures

TIMEPIECE WITH CALENDAR

This invention concerns a calendar timepiece including a dial over which are displaced at least a minutes hand and an hours hand and under which is disposed a calendar mechanism comprising at least one date ring on which is placed an index.

BACKGROUND OF THE INVENTION

The vast majority of timepieces equipped to indicate the date or, if one prefers, the day of the month, are arranged in order to cause the appearance of this date through an opening in the dial preferably placed at 3 o'clock. Certain of these timepieces are further completed by the indication of the day of the week which likewise appears in an opening. The indications relative to the date and the day of the week are borne respectively by a date ring and by a day disc arranged under the dial and forming part of the mechanism of the timepiece.

In order to go off the beaten path and to show in a different manner the data relating to the calendar, British Pat. No. 1,406,718 describes a system wherein the dial of the watch is pierced by thirty-one holes arranged facing the dates printed on the dial. Under the dial is arranged the standard date ring on which is placed a coloured index. In changing from one date to the next the index is displaced behind one of these holes in order to indicate the date. This patent shows further that the indications of the days of the week appear on a ring bearing an indication of the day by date, the ring being arranged to be displaced manually by means of a crown.

The thirty-one holes pierced in the dial exhibit an evident disadvantage: they charge the dial with marks which are difficult to conceal and the glance of the user before alighting on the date to be read, will lose time in searching this date. It will be also noted that it will be in practice necessary to reset the day of the week indication at the end of each month.

This invention has as its purpose to avoid the difficulties mentioned hereinabove in proposing at the same time a new aesthetic aspect and an immediate and easy reading of the calendar indications. In order to do so, it provides means which are defined in the claims.

SUMMARY OF THE INVENTION

The basis of the invention resides in the providing of an annular zone of transparent material forming part of the dial through which zone appears the date ring with its index, said dial bearing indications relating to the date. If the colours of the indications and of the date ring are the same and the colour of the index different from that of the indications, all indications except one will be concealed, that behind which is found the index.

DESCRIPTION OF THE PREFERRED EMBODIMENT

Figure 1A:
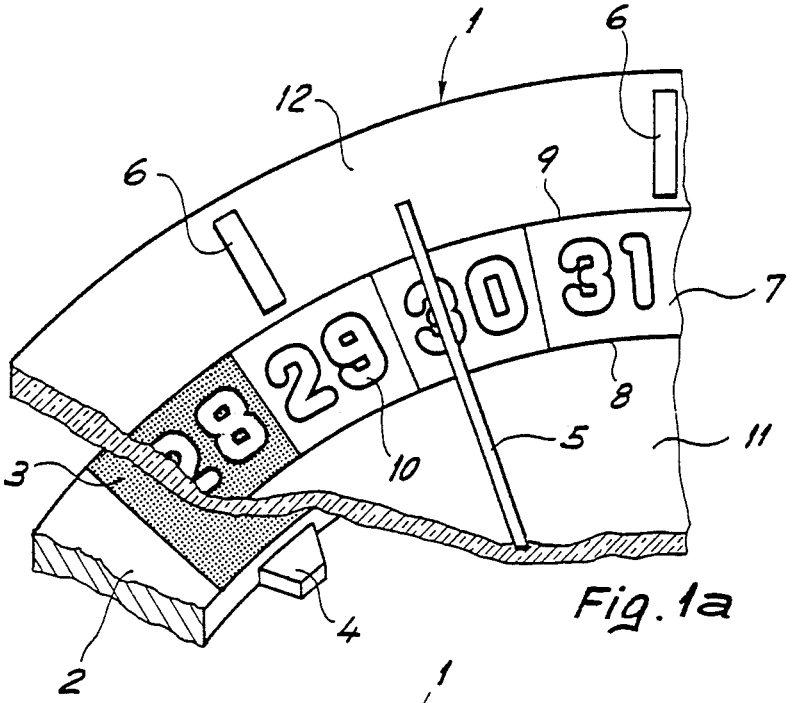
FIG. 1*a* shows a perspective view of the display system of the date according to a preferred version of the invention.

FIG. 1*a* is a partial perspective view of the date display system according to the invention and in accordance with a preferred version. The dial of the timepiece is referenced 1. Under this dial will be seen a calendar mechanism which here is limited to an indication of the date by means of date ring 2 on which is placed an index 3. The ring is driven in a well-known manner by interior teeth 4 which mesh with a mechanism controlled by the watch well-known of itself and which will neither be described nor shown here. Over the dial are displaced the hours and minutes hands 5. The dial may likewise bear hours indicia 6. According to the invention, the dial comprises in addition to the indications concerning the date, on annular zone of transparent material 7 which on drawing 1*a* is limited by lines 8 and 9. If one refers to FIG. 1*c* which is a cross-section of FIG. 1*a*, it will be seen in particular that dial 1 is obtained from transparent material formed of a mineral substance e.g. glass. Hereon have been placed indications relating to the date and referenced 10 on FIGS. 1*a* and 1*c*, on the lower surface of the glass, at the interior of the field of the annular transparent zone swept by the date ring 2 and its index 3.

Two solutions may here be envisaged according to whether one wishes to bring out or on the contrary mask the displayed date.

The first solution is shown on FIG. 1*a*. In this case the colours of ring 2 and indications 10 are identical, this having as result to cause the disappearance of all indications placed on the ring except one and precisely that which is to be displayed and which is brought out by index 3 which is found therebelow and which is of a different colour from that of the colour of the indication. One may choose white for instance for the ring and the indications (which may also be the colour of all the rest of the dial) and red for the index which will give a date displayed in white on a red background (28 on FIG. 1*a*). It will here be noted that the indications 29, 30 and 31 on FIG. 1*a* are much more apparent on the figure than they would be in reality since it is clearly necessary for illustrative purposes to bring them out by a black contour. In reality these indications are almost totally concealed if the colours for the ring and the indications are chosen to be identical. Thus in this case the dial bears thirty numbers which eventually show up and which are totally concealed and do not uselessly overload the dial.

Figure 1B:
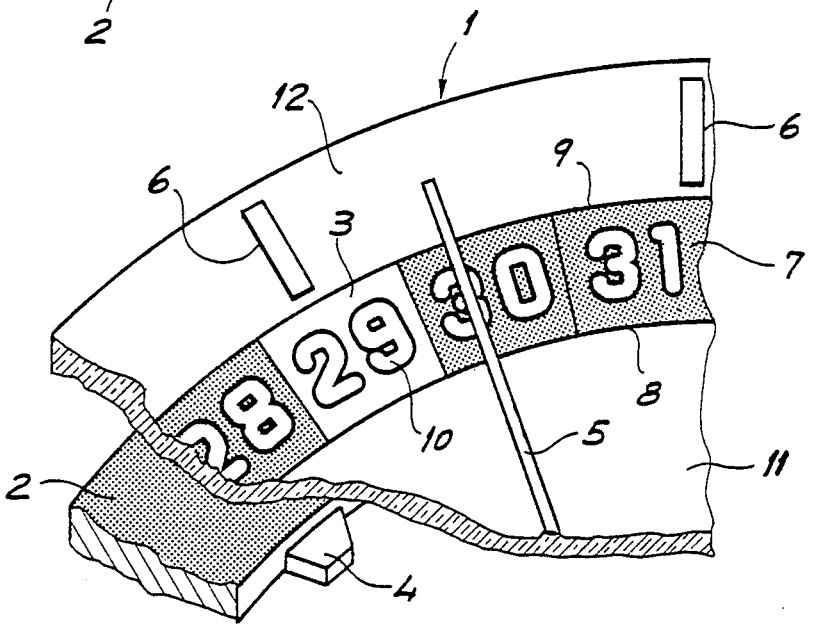
FIG. 1*b* shows a variant of the construction relative to that shown on FIG. 1*a;*

The second solution is shown on FIG. 1*b*. In this case the colours of ring 2 and the indications 10 are different, the result of which is to cause appearance of all the indications except the one which is that of the date by masking such date for, here, the colour of index 3 is the same as the colour of the indication. One may choose white for instance for the index and the indications and red for the ring. This fantasy solution may in certain cases provide an aesthetic interest and the determination of the date will be accomplished by reading the directly adjacent neighbouring indications.

Figure 1C:
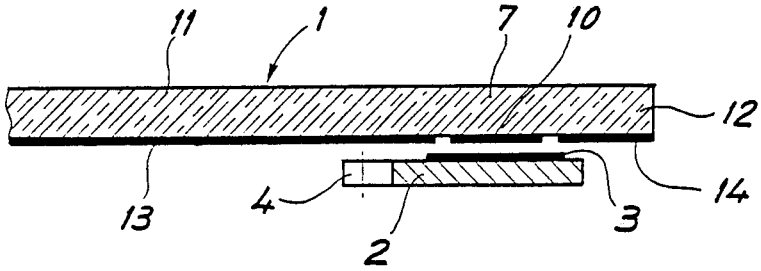
FIGS. 1*c* and 1*d* are cross-sections of the display system shown on either of FIGS. 1*a* or 1*b;*

FIGS. 1*a*, 1*b* and 1*c* also show that the dial bears a central portion 11 and a peripheral portion 12 which are opaque, this in order to hide the watch mechanism. These portions are realized in the example of FIG. 1*c* by coating one of the surfaces of the glass, for instance through metallization of the glass on its lower face as indicated by references 13 and 14 on FIG. 1*c*.

The invention is not limited to the presence of these central and peripheral portions. It could very well do without them in which case the transparent zone 7 would extend from the center to the periphery of the dial in a manner to allow seeing the entire watch mechanism should one so desire.

Figure 1D:
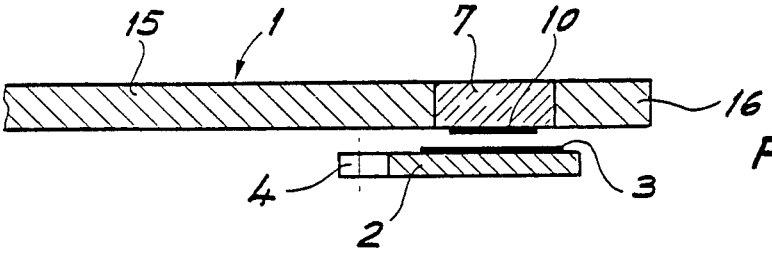

The central and peripheral opaque portions could likewise be obtained in another manner as may be seen on FIG. 1*d*. Here, the dial 1 is formed by the juxtaposition of an opaque central portion 15, an annular transparent zone 7 and a peripheral opaque portion 16. Portions 15 and 16 may be made for instance of metal. In this construction, one will preferably use plastic material for zone 7 which may easily be pressed onto the central portion 15 which in its turn may accommodate the metallic ring 16 likewise pressed on.

In the construction discussed here indications 10 relative to the calendar appear under the face of the annular transparent zone 7, so as to be as close as possible to the index 3 in order to avoid reading errors due to parallex. However, they could also appear over zone 7 if such would prove useful.

Figure 2B:
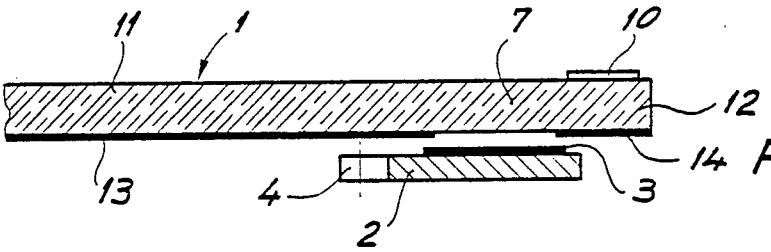
FIGS. 2*b* and 2*c* are cross-sections through the system of FIG. 2*a* according to two possibilities of realization.
Figure 2C:
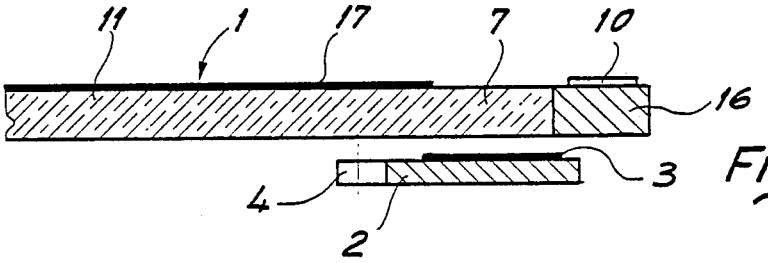
Figure 2A:
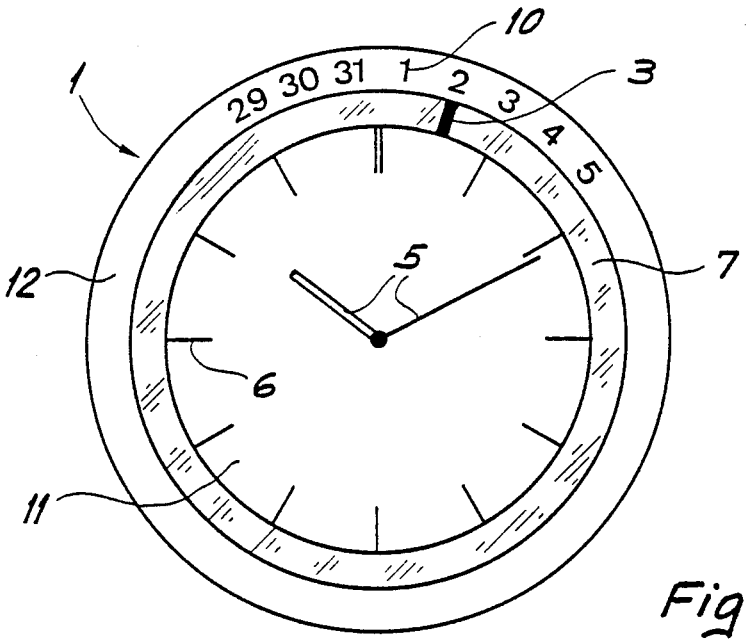
FIG. 2*a* is a further variant of the display system according to the invention.

FIGS. 2*a*, 2*b* and 2*c* are a further variant of the display system in accordance with the invention. They are distinguished essentially from what has just been discussed only by the fact that the calendar indications 10 are no longer placed on one of the faces of the transparent zone 7 but rather outside this zone while remaining proximate thereto. Thus, in the annular transparent zone 7 there appears nothing other than index 3 placed on ring 2. The date indications 10 here are on the peripheral portion 12 and the date is that which may be read opposite index 3 as may readily be seen on FIG. 2*a*. In this watch the hours and minutes index 6 appear in the central portion 11. It will be understood that the date indications could on the contrary be located in the central portion 11 while the hours index would then be placed on the peripheral portion 12. FIG. 2*b* shows that the entire dial is made of transparent material metallized at 13 in the central portion 11 and at 14 in the peripheral portion 12.

FIG. 2*c* is a special realization of the dial utilizing for the central portion and annular zone 7 a single disc of transparent material, for instance of plastic. The peripheral annular portion 16 which is of opaque material as for instance metal or coloured plastic has been pressed on over zone 7. The central portion is rendered opaque by varnish 17 placed over the dial. It will be understood that the peripheral portion 16, on FIG. 2*c*, could also be replaced by varnished plastic material. One would thus arrive at a dial entirely made of this material.

Up to the present a timepiece has been discussed indicating only the date. The invention may likewise be extended to timepieces which show the week day in addition to the date. For this variant reference will be had to FIGS. 3*a*, 3*b*, 4 and 5.

Figure 3B:
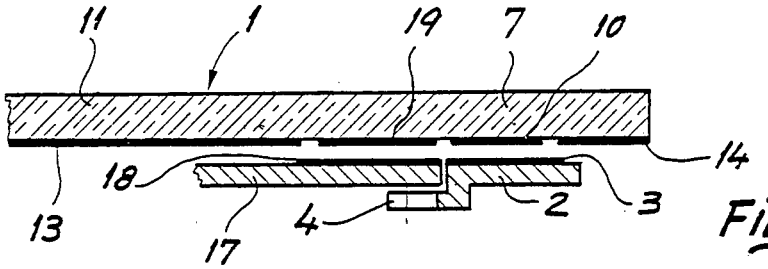
FIG. 3*b* is a cross-section of the system shown on FIG. 3*a;*
Figure 3A:
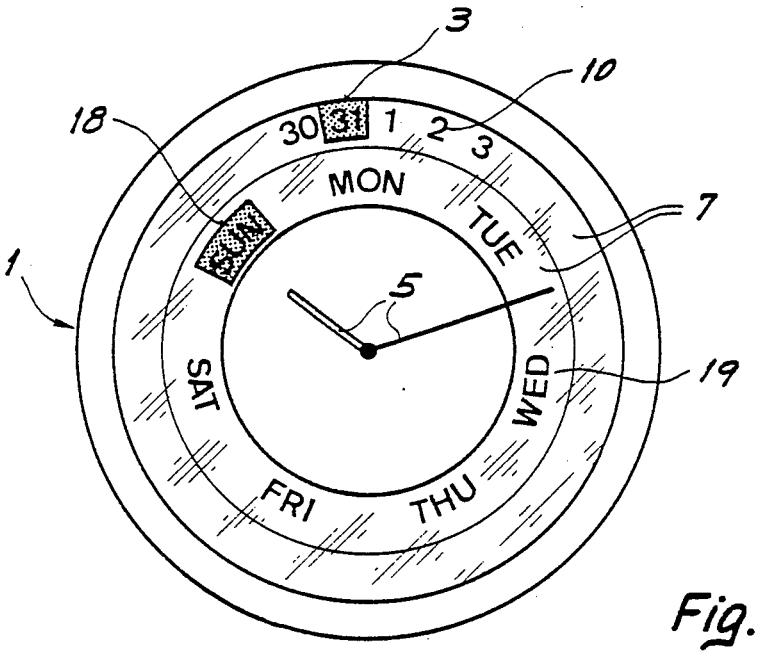
FIG. 3*a* shows a plan view of the dial face of the timepiece according to the invention whereon is shown the day of the week in addition to the date.

FIGS. 3*a* shows a plan view of such a timepiece and FIG. 3*b* is a cross-section of FIG. 3*a*. The dial bears over its upper face the minutes and hours hands 5 and below the lower face a calendar which itself includes a date ring 2 and a week days disc 17. This mechanism is driven by the timepiece in a known manner and it will not further be discussed in detail. In particular and according to a variant of the invention, the timepiece comprises a dial including an annular zone 7 of transparent material through which appears in addition to the date ring 2 the days disc 17 with which is associated index 18. According to FIGS. 3*a* and 3*b*, the lower face of the annular transparent zone 7 bears in addition to the date indications 10, indications relative to the week days 19 as for instance SUN, MON, etc. One may then envisage in order to display week days the same variants as those which have been discussed hereinabove. For instance, ring 2 and disc 17 are of the same colour as indications 10 and 19. These indications will then only be apparent when index 3 and 18 are brought into juxtaposition with one of the date and respectively day indications to the extent that the colour of these indices is distinct from the colour of the indications. FIGS. 3*a* and 3*b* show further that dial 1 is of glass and includes opaque central and peripheral portions realized by means of metallizations 13 and 14 respectively. It will be understood that other realizations are possible, in particular the utilization of plastic material or further a zone of plastic material surrounded by metal as has been discussed in respect of FIG. 1*d*, this zone being simply enlarged in order to make place for two types of indication.

Figure 4:
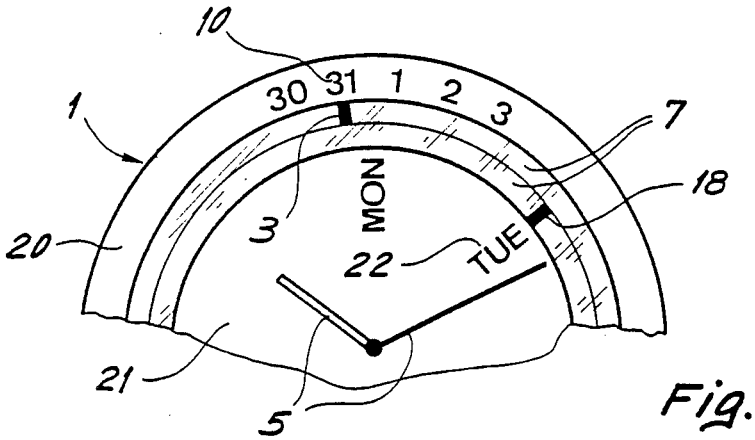
FIGS. 4 and 5 are plan views of possible variants of the display of the date and of the day.
Figure 5:
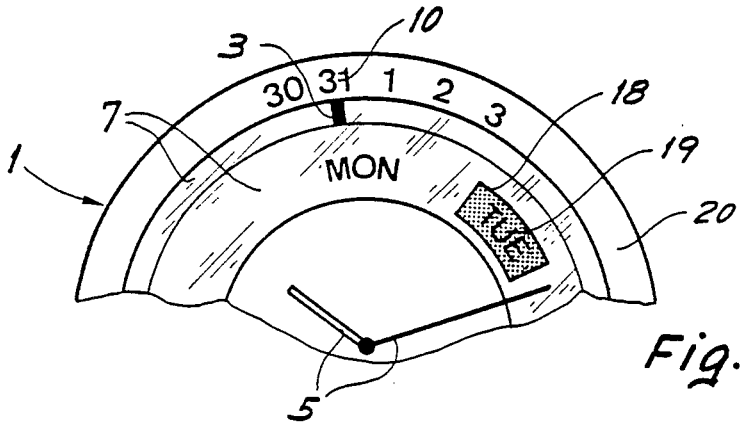

Further variants of a double display system are likewise possible. FIGS. 4 and 5 illustrate two of these variants.

FIG. 4 shows a dial 1 which exhibits an annular zone 7 embraced by opaque portions 20 and 21. The opaque portion 20 bears the date indications 10 and the opaque portion 21 that of the week days 22. The indices 3 and 18 are displaced proximate these indications in order to indicate the date and the day respectively.

FIG. 5 is a combined solution where through the annular zone 7 appears on the one hand index 3 of the date ring which is displaced proximate the date indications 10 placed on peripheral opaque portion 20 and on the other hand the index 18 of the day disc which is displaced under the days indication 19 placed on one of the faces of zone 7 to bring out or to mask said indication.

Figure 6:
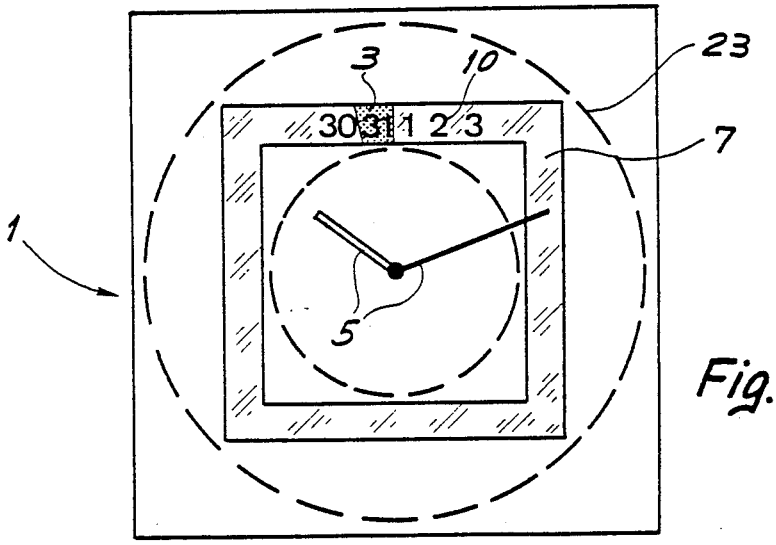
FIG. 6 shows an application of the system according to the invention when the dial is of a shaped configuration.

The examples which have been given up to the present concern a round timepiece. The invention may likewise be extended to a timepiece of shaped configuration as may be seen on FIG. 6. Here the transparent annular zone 7 is no longer circular, but of a form essentially square. In this case there will be chosen a ring 23 (shown in dotted outline on the figure) sufficiently wide to cover the transparent zone 7. All envisaged variants of the invention are naturally applicable to this configuration. Here are shown the date indications 10 which are rendered visible by the passage of index 3 under such indications.

The invention such as has just been described has as its essential purpose to give a new aesthetic aspect to the timepiece. It will be likewise noted that it provides the considerable advantage of being able to be applied to existing timepiece movements without the necessity of modifying the mechanism, the sole component to be realized in a new form being that of the dial.

What I claim is:

1. A calendar timepiece including a dial over which are displaced at least a minutes hand and an hours hand and under which is disposed a calendar mechanism comprising at least one date ring on which is placed an index, said dial including an annular zone of transparent material through which appears said date ring with its index and said dial bearing indications relating to the date.

2. A calendar timepiece as set forth in claim 1 wherein said calendar mechanism further includes a disc for the days of the week on which is placed an index, said disc with its index being arranged to appear through said annular transparent zone, said dial bearing indications relating to the days of the week.

3. A calendar timepiece as set forth in claim 1 wherein the annular transparent zone is circular.

4. A calendar timepiece as set forth in claim 1 wherein the annular transparent zone is of shaped configuration.

5. A calendar timepiece as set forth in claim 1 wherein the dial includes a central opaque portion and a peripheral opaque portion which are situated on either side of the annular transparent zone.

6. A calendar timepiece as set forth in claim 5 wherein the dial is of transparent material covered on one face by a coating which renders the central and peripheral portions opaque.

7. A calendar timepiece as set forth in claim 5 wherein the central and peripheral portions of the dial are of opaque material.

8. A calendar timepiece as set forth in claim 5 wherein the central portion and the annular zone are of transparent material, the peripheral portion is of apaque material and the central portion is covered on one face by a coating so as to render it opaque.

9. A calendar timepiece as set forth in claim 6 wherein the transparent material is a mineral substance.

10. A calendar timepiece as set forth in claim 6 wherein the transparent material is a plastic substance.

11. A calendar timepiece as set forth in claim 7 or claim 8 wherein the opaque material is a metal.

12. A calendar timepiece as set forth in claim 1 wherein the indications relating to the date are placed on one of the faces of the transparent annular zone.

13. A calendar timepiece as set forth in claim 12 wherein the date ring and said indications are visibly of the same colour while the index is of a colour different from that chosen for the indications.

14. A calendar timepiece as set forth in claim 12 wherein the date ring and the indications are of different colours, the index being the same colour as that of the indications.

15. A calendar timepiece as set forth in claim 1 wherein the indications relating to the date are placed on the dial outside the annular transparent zone but proximate said zone.

16. A calendar timepiece as set forth in claim 2 wherein the indications relating to the days of the week are placed on one of the faces of the transparent annular zone.

17. A calendar timepiece as set forth in claim 16 wherein the disc and the indications are visibly of the same colour while the index is of a colour different from that chosen for the indications.

18. A calendar timepiece as set forth in claim 16 wherein the disc and the indications are of different colours, the index being the same colour as that of the indications.

19. A calendar timepiece as set forth in claim 2 wherein the indications relating to the days of the week are placed on the dial outside the annular transparent zone but proximate said zone.

* * * * *